United States Patent [19]

Slanker

[11] 4,140,146

[45] Feb. 20, 1979

[54] SALT WATER FIRE FIGHTING SUPPLY NORMALLY EXCLUDING SALT WATER

[75] Inventor: Edwin E. Slanker, Bartlesville, Okla.

[73] Assignee: Phillips Petroleum Company, Bartlesville, Okla.

[21] Appl. No.: 821,377

[22] Filed: Aug. 3, 1977

[51] Int. Cl.[2] ..... A62C 37/00

[52] U.S. Cl. ..... 137/113; 137/567; 169/13

[58] Field of Search ..... 169/5, 13; 137/101-125, 567

[56] References Cited

U.S. PATENT DOCUMENTS 662,229 11/1900 Ewart ..... 169/5

*Primary Examiner*—Robert G. Nilson

[57] ABSTRACT

A fresh water tank or sump is positioned with respect to a salt water or seawater supply in a manner such that the level of fresh water in the sump is substantially higher than the highest expected level of the salt water. A salt water supply pipe is connected into the fresh water tank at a point well below the normal level of fresh water in the tank but at a point above the suction of at least one pump adapted to pump water for fighting fire from the tank to a fire fighting water supply system. The seawater supply pipe is equipped with a flap or equivalent valve which is maintained closed by the hydrostatic head of the fresh water which is higher than that of the salt water at said flap valve.

2 Claims, 1 Drawing Figure

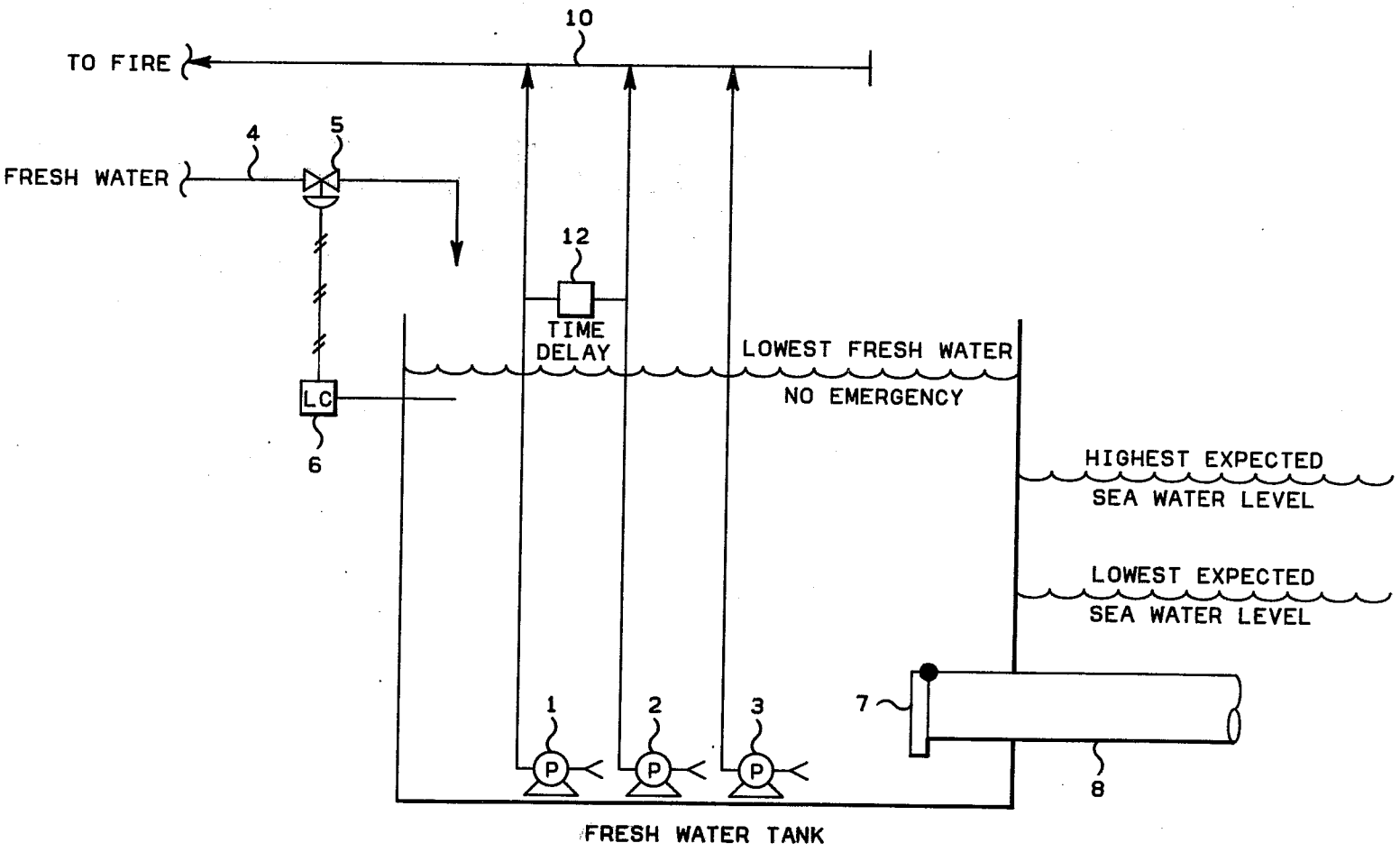
HIGHEST EXPECTED SEA WATER LEVEL
LOWEST EXPECTED SEA WATER LEVEL
8
7
LOWEST FRESH WATER NO EMERGENCY
3
2
1
P
FRESH WATER TANK
10
12
TIME DELAY
5
4
LC
6
TO FIRE
FRESH WATER

SALT WATER FIRE FIGHTING SUPPLY NORMALLY EXCLUDING SALT WATER

This invention relates to a method for providing water to a fire water system. In one of its aspects, the invention relates to such a system which normally is filled with fresh water to prevent corrosion by seawater but which in operation will automatically operate using salt water, that is, seawater.

In one of its concepts, the invention provides a fresh water system in which there is maintained a hydrostatic head or level of fresh water which is greater than a seawater supply, the seawater being supplied to the fresh water system well below the normal, nonemergency level of the fresh water, the salt water supply normally being closed by a flap or other valve responsive to hydrostatic head of the fresh water which normally will be greater than the highest expected salt water hydrostatic head. In another of its concepts, the invention provides a fresh water sump or tank, means for maintaining a level of fresh water in said tank responsive to the level of fresh water in said tank, at least one pump for delivering water from said tank to a fire fighting, fire water system, said pump being below the lowest expected seawater level, a seawater supply pipe or supply connected into said fresh water tank at a level above said pump but below the lowest expected seawater level, and means upon said pipe responsive to fresh water hydrostatic head which normally is greater than the highest expected seawater hydrostatic head to maintain closed said seawater supply pipe.

In a further concept of the invention, there is provided a water pressure maintenance pump which normally maintains a predetermined pressure in a fire water header and at least one other pump responsive to drop in pressure in said fire water header adapted to pump sufficient or desired amounts of water for fighting a fire whenever the pressure in said header drops below a predetermined value.

For fighting fire, it is desirable to have the simplest possible means which will be as inexpensive as possible and as least complicated as possible.

Normally, in locations where seawater or salt water is available, it is known to use this water for fighting fire, especially where fresh or non-salty water is available in limited supply as from a slow-flowing well. Nevertheless, it is highly desirable to avoid corrosion due to salt water. Accordingly, means have been set forth in the prior art for maintaining a fire water system filled with fresh water when nonemergency conditions exist. Such systems have been designed to, in effect, switch over to salt water whenever an emergency condition requiring large quantities of water has arisen.

It is an object of this invention to provide a fire water system. It is another object of this invention to provide a fire water system normally filled with fresh water wherein a switchover to a seawater or salt water supply will take place automatically employing for this purpose a relatively simple, inexpensive means. It is a further object of this invention to provide fire water delivery means which, without fail, will switch to the use of seawater or salt water while there is still in the system a plentiful supply of fresh water.

Other aspects, concepts, objects, and the several advantages of the invention are apparent from a study of this disclosure, the drawing, and the appended claims.

According to the present invention, there is provided a fresh water-filled fire water system in which a level of fresh water is maintained automatically well above the highest expected level of seawater and wherein a seawater supply is provided, flow of the seawater in the supply and to the fresh water-filled system being controlled simply by difference in hydrostatic head between the fresh water and the salt water.

Further, according to the present invention, there is provided a fresh water-filled fire water system comprising a fresh water tank, means for maintaining said fresh water tank filled to a predetermined level which is substantially the highest expected level of a seawater supply, at least one fire water supply pump in said tank located below the lowest expected seawater level, a seawater supply pipe connected into said tank above said pump, said seawater supply pipe having thereon a flap or other closure or valve means responsive to the difference in hydrostatic head between the fresh water and the salt water so that said flap valve will remain closed thus to prevent salt water from entering the tank so long as the fresh water level in said tank is maintained above the predetermined desired minimum.

Referring now to the drawing, there is shown fresh water tank containing pumps 1, 2, and 3 supplied by fresh water at 4. Flow of fresh water is controlled by valve 5 responsive to level sensing unit 6. The fresh water level normally is well above the lowest salt or seawater level. Thus, the hydrostatic head of the fresh water is sufficient to keep flap valve 7 on salt water inlet pipe 8 in normally closed position. Indeed, the hydrostatic head is such that any leakage at flap valve will tend to be from the fresh water tank into pipe 8 so that no salt water will enter into the fresh water tank under normal, nonemergency conditions. Pump 3 is operated responsive to the pressure in pipe 10 leading to the fire system. Pump 3 takes suction on fresh water depending upon the pressure in pipe 10 and will maintain the fire system under fresh water pressure at all times. Pump 3 is a maintenance pump and in the preferred form of the invention has an output of approximately 15 gallons per minute at 125 psig.

Pumps 1 and 2 are fire water pumps. These are the pumps which pump the fire water under emergency conditions. These pumps are capable of 1,000 gallons per minute at 135 psig and 1,500 gallons per minute at 88 psig. In the preferred form of the invention, pump 2 is operated electrically while pump 1 is operated by a diesel engine. In the event pump 2 should fail to pump sufficient fire water, pump 1 will start, with a few seconds time delay, to pump the desired fire water.

The controls and details of construction or diagramming of the control system do not form a part of this invention and have been omitted for sake of simplicity and brevity.

Whenever fresh water supply at 4 cannot maintain the normal fresh water level, that is, the level of water under nonemergency conditions, the level of the water will fall. Consequently, whenever the hydrostatic head of fresh water is insufficient to maintain flap valve 7 in closed position, seawater will enter the fresh water tank and the various pumps will instantly be supplied seawater while they are still being supplied fresh water. There will be no break in the suction.

It would be noted that the pumps are located below the lowest salt water level.

Thus, according to the invention, no pumping whatever is needed to supply the salt water to the suction of the pumps. No valve needs to be open. The flap valve 7 will open automatically responsive to the pressure of the seawater when it exceeds that pressure of the fresh water which is required to keep flap valve 7 closed.

The flap valve can be so constructed and weighted or biased that it will open well before the level of the fresh water has dropped to the level at which the pumps are located.

The fire water tank or sump and distribution system are normally filled with fresh water from wells and, of course, will be flushed out with fresh water after fire fighting with seawater.

In one installation, the fresh water in the tank or sump has a level normally about 14 feet above the mean level of the salt or seawater.

It will be seen that the invention eliminates the complicated control apparatus of prior art such as shown in U.S. Pat. No. 662,229, Nov. 20, 1900, J. Ewart. The invention provides a flooded suction, the pumps are filled with fresh water and are not subject to corrosion from the seawater. When fire water is required in quantities substantially larger than available in the fresh water tank or sump above the suction of the pump, the sewater automatically will enter into the sump.

Maintenance pump 3 provides continuous relatively high water pressure in the fire water pipe 10. This is useful for control purposes. When a valve in the fire water pipe 10 is opened, as during an emergency, pressure in the line falls and pressure controls start the main fire pumps 2 and/or 1 and keep it or these running as long as necessary. Normally, pump 1 is a standby for pump 2, pump 1 being operated by a battery-started diesel engine while pump 2 is operated by an electric motor.

Time delay 12 operates responsive to discharge pressure from pump 2 and will start pump 1 if it is not already operating.

One skilled in the art will understand upon study of this disclosure that the control mechanisms, circuitry, and other arrangements involving the several pumps can be varied, yet yield the desired pumping of water as described herein.

Reasonable variation and modification are possible within the scope of the foregoing disclosure, drawing, and appended claims to the invention the essence of which is that there has been set forth a combination fresh and salt water fire fighting supply essentially comprising in combination a fresh water tank or sump, a salt water inlet to said sump, a flap valve or equivalent mechanism for normally keeping salt water from the sump responsive to the hydrostatic head of fresh water in the sump, normally for this purpose sufficiently above the highest salt water level expected, a fresh water inlet to said sump responsive to level of fresh water in said sump to maintain the desired level of water in said sump, and at least one pump located in said sump below the lowest expected seawater level, a water delivery system to which said pump delivers water, said pump being responsive to pressure in said water delivery system to pump water thereto whenever the pressure in said delivery system falls below a predetermined value.

I claim:

1. A fire water supply system comprising a fresh water storage tank or sump filled with fresh water to a predetermined level well above the highest expected level of a seawater supply, means for maintaining said tank filled with fresh water to said predetermined level, at least one pump in said tank adapted to pump water from said tank to a fire water supply header or pipe, a seawater supply pipe connected into said tank above said pump but well below said predetermined level of fresh water therein, means upon said supply pipe to prevent flow of seawater in and from said pipe into said tank, said means remaining closed responsive to the hydrostatic head of fresh water in said tank above the level of seawater in said seawater supply.

2. A system according to claim 1 wherein said seawater supply pipe is equipped at its tank end with a flap valve so constructed and arranged that it will remain normally closed when said predetermined level of fresh water is being maintained in said tank.

* * * * *